United States Patent [19]

Pfotenhauer

[11] 4,050,438

[45] Sept. 27, 1977

[54] SPRING TYPE PROJECTING DEVICE

[76] Inventor: James M. Pfotenhauer, 1302 N. 19th St., Escanaba, Mich. 49829

[21] Appl. No.: 705,008

[22] Filed: July 14, 1976

[51] Int. Cl.[2] ..... F41B 7/00

[52] U.S. Cl. ..... 124/20 R; 124/80

[58] Field of Search ..... 124/20 R, 20 B, 27, 124/26, 41 R, 41 A, 22, 86, 17, 80; 42/72, 94, 1 L

[56] References Cited

U.S. PATENT DOCUMENTS

| | | | |
|---|---|---|---|
| 310,873 | 1/1885 | Bradley | 124/21 |
| 2,540,303 | 2/1951 | Sylvester | 124/21 |
| 2,825,323 | 3/1958 | Huszar | 124/20 R |
| 3,609,902 | 10/1971 | Casull | 42/94 X |
| 3,783,852 | 1/1974 | Shepherd | 124/22 |
| 3,918,427 | 11/1975 | Turner | 124/20 B |
| 3,949,729 | 4/1976 | Pfotenhauer | 124/20 R X |

*Primary Examiner*—Richard C. Pinkham
*Assistant Examiner*—William R. Browne
*Attorney, Agent, or Firm*—Burns, Doane, Swecker & Mathis

[57] ABSTRACT

A slingshot comprises a stock having front and rear ends. A manual gripping handle is disposed at the rear end of the stock. A pair of sheaves are rotatably mounted adjacent the front end and rear end of the stock on opposite sides of the fore-to-aft longitudinal axis of the stock. These sheaves are rotatable about generally upright parallel axes of rotation. An elastic band is provided having outer free ends anchored at points disposed adjacent the rear end of the stock on opposite sides of the fore-to-aft longitudinal stock axis. The elastic band extends forwardly from these anchoring points and is wrapped around the rotatable sheaves. The elastic band includes a pouch capable of carrying an object to be propelled. Upon displacement, the band is stretched in an energy-storing fashion so as to propel the object forwardly upon release. This arrangement provides an inordinately long length of elastic band, thereby increasing the ability of the band to stretch and maximizing its energy-storing capacity. As a result, the velocity of fired projectiles can be significantly increased without appreciably increasing the force required to extend the band, or the length of the stock.

7 Claims, 5 Drawing Figures

SPRING TYPE PROJECTING DEVICE

BACKGROUND AND OBJECTS

This invention relates to a slingshot.

Slingshot devices for propelling objects have long been known wherein an elastic member has its ends anchored to a frame and has a pouch for carrying objects to be propelled. Traditionally, these devices have been in the form of hand held articles wherein the frame, at its front end, includes upright legs to which the elastic member is anchored. A depending arm is gripped by one hand of a user and the pouch is retracted by the other hand to tension the band.

Various modifications have been proposed for increasing the accuracy and distance of the slingshot, such as the use of an arm brace extending rearwardly from the depending arm to provide the shooter with more control. Notwithstanding such modifications, though, the distances to which projectiles could be fired from slingshots have been severely limited.

It is, therefore, an object of the present invention to provide a slingshot which is capable of maximizing the power and distance of object propulsion.

It is another object of the invention to provide such a slingshot in which a high degree of accuracy is maintained.

It is a further object of the invention to provide a novel slingshot capable of increasing the velocity of fire projectiles without appreciably increasing the stock length or the force required to extend the band.

BRIEF DESCRIPTION

These objects are achieved by the present invention which involves a slingshot having a stock which includes front and rear ends. A manual gripping handle is disposed at the rear end of the stock. A pair of sheaves are rotatably mounted adjacent the front end of the stock opposite sides of the fore-to-aft longitudinal axis of the stock. These sheaves are rotatable about generally upright parallel axes of rotation. An elastic band is provided having outer free ends which are anchored at points disposed adjacent the rear end of the stock on opposite sides of the fore-to-aft longitudinal stock axis. The elastic band extends forwardly from these anchoring points and is wrapped around the rotatable sheaves. The elastic band includes a pouch capable of carrying an object to be propelled. The pouch is disposed for manual rearward displacement in a direction parallel to the axis to stretch the elastic band in an energy-storing fashion throughout the length thereof so as to propel the object forwardly upon release.

THE DRAWINGS

The invention will be described in terms of a preferred embodiment thereof in which.

DETAILED DESCRIPTION

Figure 1:
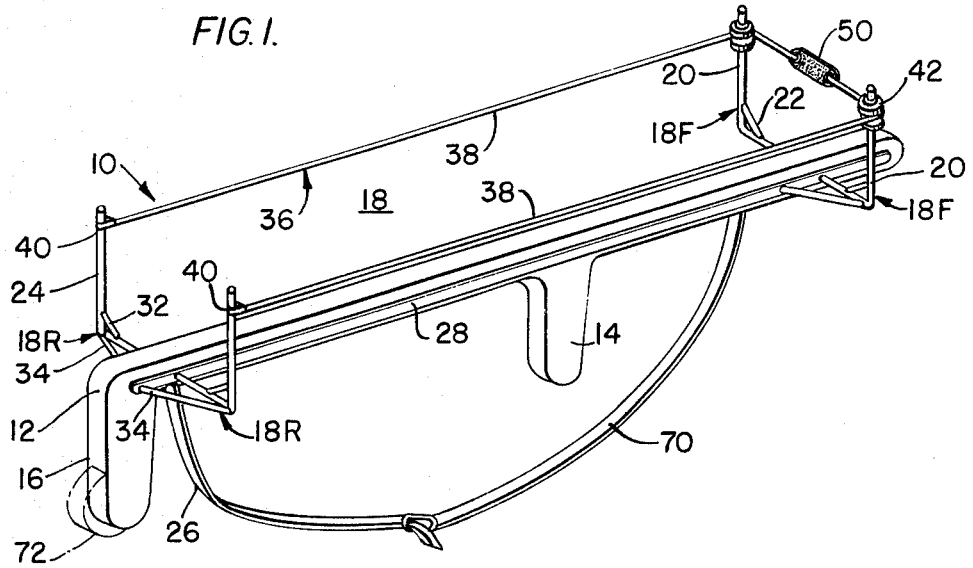
FIG. 1 is an isometric view of a slingshot in accordance with the present invention in a rest condition.
Figure 2:
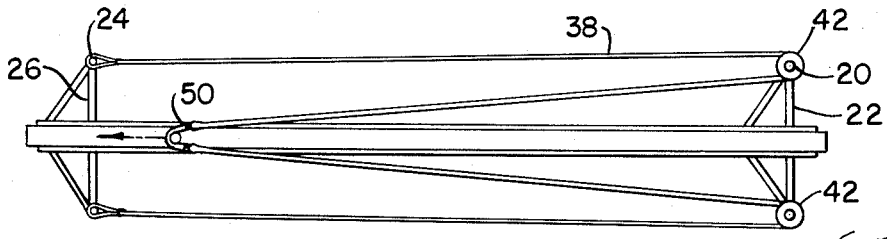
FIG. 2 is a plan view of the slingshot depicted in FIG. 1.

In accordance with the present invention, a slingshot 10 includes a stock 12 having front and rear ends. The stock 12 is preferably fabricated of wood, although almost any material may be suitable. Just forwardly of its rear end the stock includes a downwardly depending manual gripping handle 14. Located therebehind is a downwardly depending brace 16 for reasons to be discussed subsequently. Fixedly mounted to the stock on opposite sides of a longitudinal, i.e., fore-to-aft extending axis through the center of the stock are a plurality of front and rear support frames 18F, R.

Each front support frame 18F comprises a piece of bar stock bent to form a front upright section 20, and a front mounting section 22 extending perpendicularly from the bottom of the front upright section and being fixedly connected to the stock.

Each rear support frame 18R comprises a piece of bar stock bent to form a rear upright section 24 extending parallel to the front upright section 20 and a rear mounting section 26 extending at a right angle from the bottom of the rear upright section and being fixedly connected to the stock.

The frame 18F, R can be rigidly fastened to metal mounting plates 28 which are secured to the sides of the stock 12.

Suitable bracing struts 32, 34 can be provided to rigidify the front and rear upright sections 20, 24.

A power unit in the form of an elastic band assembly 36 is operably mounted to the support structures 18. The elastic band assembly comprises a pair of elastic band segments 38 to the outer free ends 40 of which are anchored, such as being tied, to the rear upright sections 24. A steel pin can be inserted through the band to maintain this condition. Each segment 38 extends forwardly from its anchored point and is wrapped around a sheave 42. Each segment 38 can comprise a section of rubber tubing such as surgical hose, for example.

Figure 4:
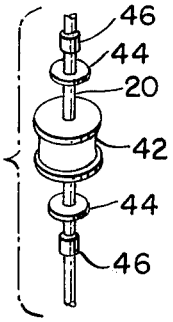
FIG. 4 is a fragmentary, exploded view of a forward sheave around which the elastic band is wrapped.

Each sheave 42 is rotatably mounted to its associated front upright section 20 intermediate the height thereof. The rotary mounting of the sheave can be achieved in any suitable manner, such as by positioning a pair of washers 44 on the front upright section 20 above and below the pulley 42 and retaining the washers in place by tape 46 or the like, as indicated in the exploded showing of FIG. 4.

Figure 3:
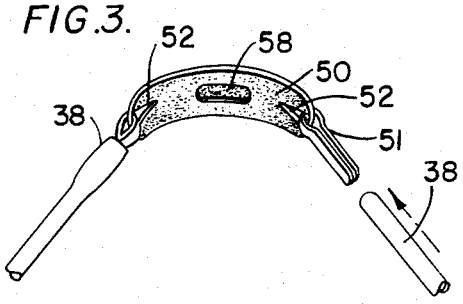
FIG. 3 is a fragmentary view depicting a pouch portion of an elastic band component of the slingshot.

The inner ends 48 of the elastic band segments are connected to the opposite ends of a pouch defining strip 50 preferably formed of leather (FIG. 3). More particularly, bifurcated clamps 51 formed of Teflon or polyethylene are inserted into slots 52 formed in the pouch 50. The elastic band segments 38 are forced over the legs of the clamp as the legs of the clamp are squeezed together (FIG. 3). Subsequently, the clamp is released, with the legs being biased outwardly into tight gripping contact with the inner wall of the tubular band to provide an extremely strong connection. If desired, a tubular strip of leather can be applied around the band in the region of the clamp to prevent damage if this region of the band strikes the sheaves.

The pouch-defining strip 50 includes a slot 58 located intermediate the ends of the strip 50. Fabric may be sewn to the back of the strip so as to provide a backing for the slot. Such a slot is of tremendous aid in centering a projectile, such as a steel ball for example. Otherwise, the ball might have a tendency to wander within the pouch during cocking and become disoriented, possibly resulting in a misdirected shot being fired.

Figure 5:
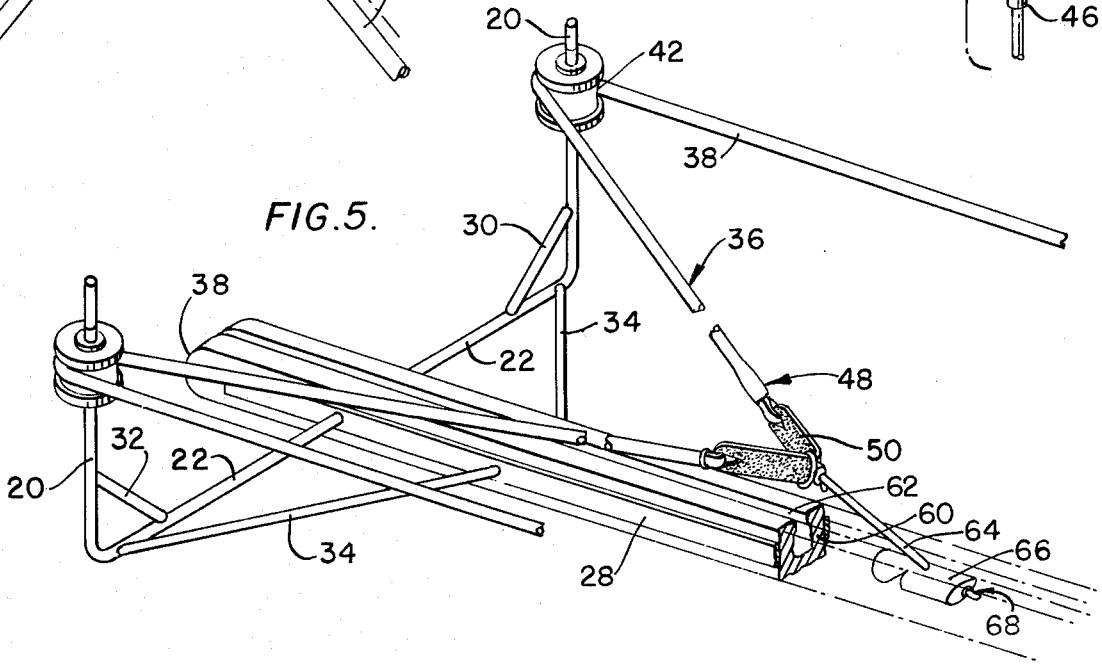
FIG. 5 is an isometric view of a front portion of a slingshot according to the present invention which employs a projectile slot and ejector slide therefore.

Instead of firing from the pouch, a shooter may desire high accuracy. Accordingly, in a modified form of the invention, a firing channel 60 is provided in the stock 12 (FIG. 5). This channel is open at its front end and is also open along its upper extent 62. A flexible connector, such as a string 64 interconnects the strip 50 with a slide 66. The slide 66 is sized to slide within the channel 60. The string 64 passes through an opening in the slide and can be knotted at its outer end 68 to prevent removal of the string from the slide.

To connect the string 64 to the pouch strip 50, it may merely be tied around the latter.

Attention is directed to copending application Ser. No. 538,802 of the present inventor for a more detailed description of the channel and slide assembly.

The slingshot according to the present invention can be fabricated in any desired size. One such slingshot has been constructed over four feet in length. In order to facilitate transporting of the slingshot, a strap 70 can be attached to the frame, enabling the slingshot to be carried on the back of a shooter.

The brace 16 can be braced against the body, e.g., the chest, of a shooter during firing. To facilitate bracing against the leg, a curved abutment knob 72 (shown in phantom lines in FIG. 1) can be added to the brace stock 16.

OPERATION

To propel an object, such as a steel ball, directly from the pouch, the ball is inserted into the pouch. The pouch is grasped and squeezed and then retracted. The ball remains centered within the pouch due to being seated within the slot 58.

As the pouch is retracted, the elastic band is tensioned and stretched. Due to the inordinately long length of the elastic band segments, there is inherently present a large capacity for stretching. Thus, a high degree of deflection can be obtained resulting in the storage of considerable energy within the band. Consequently, the ball can be propelled with high power for relatively long distance.

Elongation of the band is facilitated by the sheaves. That is, friction is minimized by rotation of the sheaves, making it easier to tension the band with less tendency for frictional wear to occur.

The result is a long distance, long life slingshot which can be easily manipulated by the shooter. For accuracy shooting, the channel-slide arrangement of FIG. 5 can be employed in which the projectile, such as a ball or dart, is driven by the slide 66 and is guided by the channel 60 during acceleration.

As the band is being tensioned, the support structures 18 provide ample rigidity for the front upright to prevent deformation thereof.

The elastic band is subjected to reduced wear as compared with slingshots whose band ends are anchored at the front of the stock and which lie slack therebetween when in a rest condition. In the case of such slingshots, the band, when released, contracts until reaching a forward position; thereupon, the slackened band travels forwardly under its own momentum, causing the band to turn 180 degrees about the front anchoring points to accommodate the further, forward travel. This action, when repeated numerous times, has a weakening effect upon the band at the anchoring points. No such action occurs in the present invention since the anchoring points are disposed at the rear, and since the band, when at rest, extends straight, i.e., linearly from sheave to sheave as shown in FIG. 1. Thus, when released, the band contracts until assuming the FIG. 1 posture and then re-extends slightly. As a result, only slight turning of the band is experienced.

Although the invention has been described in connection with a preferred embodiment thereof, it will be appreciated by those skilled in the art that additions, modifications, substitutions, and deletions not specifically described may be made without departing from the spirit and scope of the invention as defined in the appended claims.

What is claimed is:

1. A slingshot comprising:

a stock having front and rear ends;

manual gripping handle means disposed at the rear end of said stock;

a pair of sheaves rotatably mounted adjacent the front end of said stock on opposite sides of the fore-to-aft longitudinal axis of said stock;

said sheaves being rotatable about generally upright parallel axes of rotation;

elastic band means having outer free ends thereof anchored at points disposed adjacent the rear end of said stock on opposite sides of said fore-to-aft longitudinal stock axis;

said elastic band means extending forwardly from said anchoring points and being wrapped around said rotatable sheaves;

said elastic band means including a pouch capable of carrying an object to be propelled;

said pouch disposed for manual rearward displacement in a direction parallel to said axis to stretch said elastic band means in an energy-storing fashion throughout the length thereof so as to propel said object forwardly upon release; and front and rear support frames mounted on opposite sides of said fore-to-aft extending stock axis; each front frame including:

a front sheave mount section rotatably carrying one of said sheaves above the plane of said stock, and a front section extending generally at a right angle from said front mounting section generally at a right angle from said front section and fixedly connected to said stock, each rear frame comprising a rear section extending generally parallel to said front section and rear mounting section extending generally at a right angle from said rear section and being fixedly connected to said stock;

each of said free ends of said elastic band means being connected to one of said rear upright sections.

2. A slingshot according to claim 1 wherein said elastic band means comprises a pair of elastic band segments; the outer free end of each segment being anchored to said stock and the other end of each segment being connected to one side of said pouch; said pouch comprising a flexible strip having a slot formed therein and only partially therethrough intermediate its ends for centering objects to be propelled.

3. A slingshot according to claim 1 including a channel extending fore-to-aft along said stock; said channel being forwardly and upwardly open; an impact side being slidable within said channel; and a flexible connector connecting said pouch to said slide so that forward movement of said pouch pursuant to release of a tensioned band is transmitted to said slide to drive said slide forwardly to propel from said channel objects located in said channel thereahead.

4. A slingshot according to claim 1 wherein said gripping handle means is disposed at a point located forwardly of the rear end of said stock; a bracing stock portion depending downwardly from said stock behind said handle, said brace stock portion being engageable with the body of a shooter to support said stock during firing.

5. A slingshot according to claim 4 wherein said bracing stock portion includes a curved abutment knob projecting rearwardly from a bottom end of said bracing stock portion for engagement with the leg of a shooter during firing.

6. A slingshot according to claim 1 wherein said band means, when in a rest condition, includes a portion extending linearly from one of said sheaves to the other, across the front of said stock.

7. A slingshot according to claim 1 wherein said pouch includes slots at each end; said band means comprising bifurcated clamps mounted in said slots and a pair of elastic tubular band segments mounted over and in tight frictional contact with leg portions of each bifurcated clamp.

* * * * *